US005890803A

United States Patent [19]

Jolink

[11] Patent Number: 5,890,803

[45] Date of Patent: Apr. 6, 1999

[54] CONICAL MIXING DEVICE COMPRISING AT LEAST ONE MIXING SCREW AND A FAST ROTATING HORIZONTAL ROTOR ON A VERTICAL DRIVE SHAFT

[75] Inventor: Jan Willem Jolink, Varsseveld, Netherlands

[73] Assignee: Hosokawa Micron BV, Netherlands

[21] Appl. No.: 966,055

[22] Filed: Nov. 7, 1997

[51] Int. Cl.[6] ..... B01F 7/08; B01F 15/02

[52] U.S. Cl. ..... 366/170.3; 366/287

[58] Field of Search ..... 366/64–66, 96–98, 366/170.3, 287, 288, 292, 318, 330.1

[56] References Cited

U.S. PATENT DOCUMENTS

| | | | |
|---|---|---|---|
| 1,720,573 | 7/1929 | Roberts, Jr. | 366/170.3 |
| 3,614,070 | 10/1971 | Loomans | 366/287 |
| 3,659,826 | 5/1972 | Nauta | 366/287 |
| 4,437,766 | 3/1984 | Joachim | 366/287 |
| 5,123,748 | 6/1992 | Schroer | 366/287 |

FOREIGN PATENT DOCUMENTS

| | | | |
|---|---|---|---|
| 0406981 | 9/1991 | European Pat. Off. . | |
| 2076009 | 10/1971 | France . | |
| 3505175 | 8/1986 | Germany | 366/287 |
| 44-1756 | 8/1964 | Japan | 366/287 |
| 281191 | 12/1964 | Netherlands . | |
| 7101764 | 8/1972 | Netherlands . | |
| 1533862 | 1/1990 | U.S.S.R. | 366/287 |
| 1428821 | 3/1976 | United Kingdom | 366/287 |
| 2094651 | 9/1982 | United Kingdom . | |

*Primary Examiner*—Charles E. Cooley
*Attorney, Agent, or Firm*—Hayes, Soloway, Hennessey, Grossman & Hage, P.C.

[57] ABSTRACT

A device for mixing powdery, granular and/or pasty material, which device comprises a conical mixing vessel having a vertical axis, and at least one mixing screw that extends parallel to the inside wall of the mixing vessel. The mixing screw is mounted on a drive unit that extends into the mixing vessel, for rotation around its axis, and also revolves slowly around the innerside of the mixing vessel. A high speed rotor is mounted in a open cage which is hung from the drive unit. Completing the mixing device separate driving motors mounted outside the vessel, for driving the rotor and the mixing screw.

8 Claims, 1 Drawing Sheet

CONICAL MIXING DEVICE COMPRISING AT LEAST ONE MIXING SCREW AND A FAST ROTATING HORIZONTAL ROTOR ON A VERTICAL DRIVE SHAFT

BACKGROUND OF THE INVENTION

The invention relates to conical mixing devices including a motor driven mixing screw.

A device of this type is described in the non-prepublished PCT/NL/00186.

Certain cohesive products and those one that quickly form agglomerates are difficult to mix. Moreover, certain mixtures exacerbate the problem due to introduction of heat generated by friction between the rotor and the product being mixed.

SUMMARY OF THE INVENTION

It is therefore an object of the present invention to provide a conical mixing device which overcomes the aforesaid and other disadvantages of the prior art. More particularly, in accordance with the present invention there is provided a device for mixing powdery, granular and/or pasty material, which device comprises a conical mixing vessel having a vertical axis, and at least one mixing screw that extends parallel to the inside wall of the mixing vessel. The mixing screw is mounted on a drive unit that extends into the mixing vessel, for rotation around its axis, and also revolves slowly around the inner side of the mixing vessel. A high speed rotor is mounted in a open cage which is hung from the drive unit. Completing the mixing device separate driving motors mounted outside the vessel, for driving the rotor and the mixing screw.

BRIEF DESCRIPTION OF THE DRAWINGS

The invention will now be further described in connection with the accompanying drawings wherein like numerals depict like parts, and wherein.

DETAILED DESCRIPTION OF PREFERRED EMBODIMENTS

Figure 1:
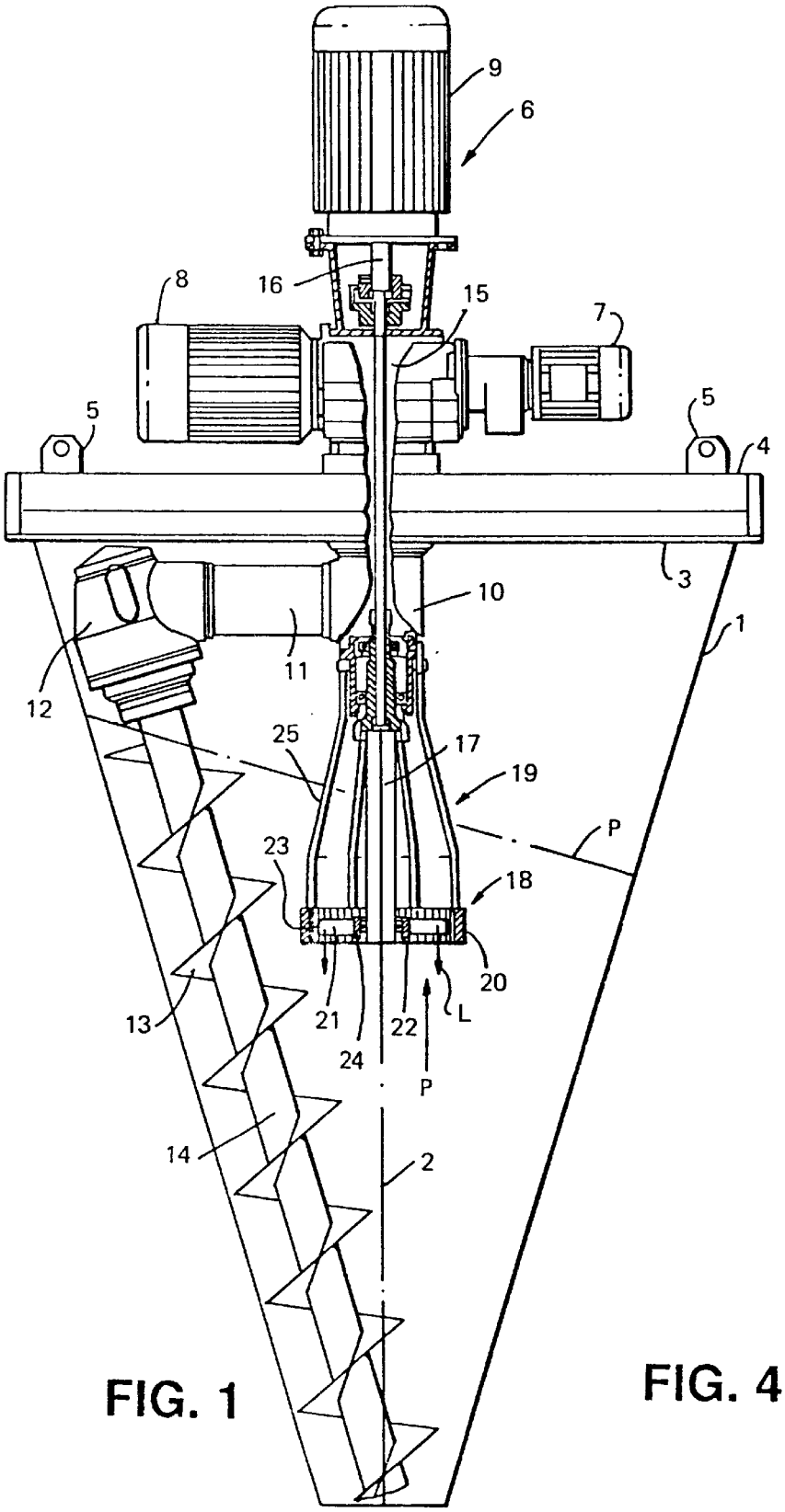
FIG. 1 shows a schematic axial cross-section over a first embodiment of the mixing device according to the invention.

Referring to FIG. 1 of the drawings, there is shown a mixing device comprising a conical mixing vessel 1 having a vertical symmetry axis 2. The upperside of the mixing vessel 1 is closed by a lid 3, that is fastened to a support structure 4. This support structure 4 has on both sides a pair of hoisting eyes 5. On this support structure is mounted a drive unit, generally indicated at 6, having two electrical horizontally mounted motors 7 and 8 on the outside of the mixing vessel 1. Electronic motor 8 is somewhat larger than electronic motor 7. Drive unit 6 extends into the inside of the mixing vessel 1 and includes a central shaft 10 having a swing arm 11. Swing arm 11 is driven by relatively small electrical motor 7, in a rotating movement around the symmetry axis 2 and carries the head 12 of the mixing screw 13 a slow circular revolving movement along the inner wall of the mixing vessel 1. A mixing screw 13 is mounted by its shaft 14 in the head 12 or swing arm 11 and is driven by electrical motor 8, through a transmission in the swing arm 11, not shown, at a somewhat higher number of revolutions around its own symmetry axis.

According to the invention the central shaft 10 of the drive unit 6 has a passage 15 for a vertical drive shaft 16 which carries a rotor, generally indicated with 18, on the lower side of the lower part 17 of the drive shaft with a larger diameter. Drive shaft 16 is driven by a vertically mounted variable speed electrical motor 9. Preferably rotor 18 is mounted substantially horizontally for relatively fast rotation. The side and upper side of the rotor 18 is surrounded by a bottle shaped open cage 19. Cage 19 comprises a number of bent rods 25, which are at their upper ends to the lower side of the central shaft 10. The lower ends of the rods 25 are connected to a substantially horizontal ring shaped hoop 20. The outer circumference of the hoop 20 is located adjacent the inner circumference of the path of the sloping mixing screw 13. Thus the rotor 18 further mixes and/or homogenizes the material flow which is transported upwardly by the mixing screw 13 which thereafter flows back downwardly.

Figure 2:
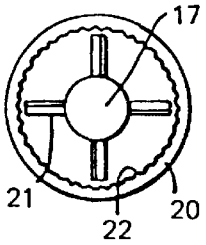
FIGS. 2 and 3 show a bottom view on the rotor in its cage according to a first and second embodiment of the invention.

According to the embodiment shown in FIGS. 1 and 2 the inside of the hoop 20 is provided with ribs 22, which together with the rotor blades 21 effect a grinding action. Alternatively, in the embodiment shown in FIG. 3 the inside of the hoop 20 has a smooth even surface.

Preferably, the rotor shaft 16, 17, the rotor 18, and the blades 21 are hollow and the hollow spaces are interconnected so that liquid L may be delivered to spraying orifices 23 for spraying the product P in the mixing vessel 1 with a liquid L.

Figure 3:
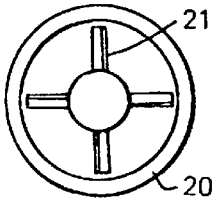

The rotor 18 which is shown in FIGS. 2 and 3 with four blades may have any number of blades. Moreover, the blades 21 may have different attack angles A on the central hub 24.

Figure 4:
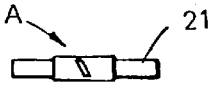
FIGS. 4 and 5 show in side view a detail of the rotor according to a third and fourth embodiment respectively of the invention.
Figure 5:
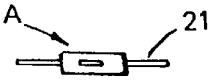

FIGS. 2 and 4 show an attack angle A of about 45 degrees, whereas FIGS. 3 and 5 show an attack angle A of 0 degrees. Blades 21 also may be made substantially flat or other profile.

The action of the rotor is as follows: the rotor 18 rotates in the product P, which flows downwardly along a sloping angle from the upper end of the mixing screw 13. Rotor 18 is rotated at a significantly higher rotation speed than the mixing screw 13. The rapidly rotating rotor 18 captures a portion of the downwardly flowing product and intensely mixes the product.

Thus cohesive products and those which quickly can form agglomerates are readily homogenized with the rest of the product P.

If desired the product P can be sprayed with liquid L delivered from the spraying orifices 23 during the mixing process.

I claim:

1. A mixing device for powdered granular and/or paste materials, comprising:

a conical mixing tank having a vertical axis which narrows towards the bottom, a central vertical shaft projecting into said conical mixing tank;

a mixing screw in said mixing tank, said mixing screw being mounted on a transmission arm which in turn is mounted for revolving around said central vertical shaft, said mixing screw having an axial shaft running essentially parallel to a describing line of a wall of the mixing tank;

a drive motor disposed outside of the mixing tank for driving said mixing screw through said transmission arm whereby said mixing screw simultaneously rotates on its own axis, and revolves around the wall of the mixing tank, and, a rotor driven by an external motor, and mounted to rotate with a vertical drive shaft extending through said central vertical shaft, wherein the rotor and drive shaft are disposed within an open cage which is hung form the central vertical shaft, and wherein the rotor rotates at a rotational speed substantially greater then the rotational speed of the screw.

2. A device according to claim 1, wherein the rotor and the mixing screw are driven by separate motors.

3. A device according to claim 1, and further comprising, a motor disposed outside of the mixing tank for driving the revolving transmission arm.

4. A device according to claim 1, wherein the rotor includes a central hub attached to said vertical drive shaft, and further comprises a plurality of blades fastened to said central hub.

5. A device according to claim 1, wherein the cage terminates at its bottom in a circular hoop.

6. A device according to claim 5, wherein the inside wall of the hoop is smooth.

7. A device according to claim 5, wherein the inside wall of the hoop has plurality of ribs.

8. A device according to claim 1, wherein the rotor includes spray orifices, and wherein the rotor drive shaft and rotor include a continuous channel formed therein for delivering a liquid to said spray orifices.

* * * * *